US005567182A

United States Patent [19]

Ishii et al.

[11] Patent Number: 5,567,182

[45] Date of Patent: Oct. 22, 1996

[54] ULTRA MULTIPLE CONNECTOR

[75] Inventors: Takashi Ishii; Tamio Watanabe; Toru Nagano, all of Shizuoka-ken, Japan

[73] Assignee: Yazaki Corporation, Tokyo, Japan

[21] Appl. No.: 317,394

[22] Filed: Oct. 4, 1994

[30] Foreign Application Priority Data

Oct. 5, 1993 [JP] Japan ..... 5-054014 U

[51] Int. Cl.[6] ..... H01R 13/502

[52] U.S. Cl. ..... 439/701; 439/364

[58] Field of Search ..... 439/701, 362, 439/364, 695

[56] References Cited

U.S. PATENT DOCUMENTS

| | | | |
|---|---|---|---|
| 3,072,340 | 1/1963 | Dean | 439/701 |
| 4,963,098 | 10/1990 | Myer et al. | 439/76 |
| 5,378,173 | 1/1995 | Hashizawa | 439/701 |

FOREIGN PATENT DOCUMENTS

| | | |
|---|---|---|
| 0384577 | 8/1990 | European Pat. Off. . |
| 0592102 | 4/1994 | European Pat. Off. . |
| 4224528 | 2/1993 | Germany . |

OTHER PUBLICATIONS

Japanese Laid–Open Appln. No. 63–3075 filed 9 Jan. 1988 (with English Abstract).

Japanese Laid–Open Appln. No. 6–60936 4 Mar. 1994 (with English Abstract).

Japanese Laid–Open Appln. No. 53–39491 4 Nov. 1978 (with English Abstract).

*Primary Examiner*—Khiem Nguyen

*Assistant Examiner*—Yong Ki Kim

*Attorney, Agent, or Firm*—Venable, Baetjer, Howard & Civiletti

[57] ABSTRACT

Disclosed is an ultra multiple connector for use in connecting of a wire harness, etc., having a frame for mounting a plurality of connectors and adapted to connect the frame to a mating connector, the ultra multiple connector being capable of securing mounting of connector housing onto the frame and mounting of rear holder onto the housing. A plurality of hollows each opened upwardly and downwardly are formed on the frame, and one or more connector housing connected to a wire harness is loaded into each of the hollows. The depth of the hollow of the frame is shorter than the length of the connector housing so that a portion of the connector housing in its mounted state is exposed from the frame, and an engaging aperture is formed on a side surface of the portion of the connector housing to be exposed. A rear holder is removably mounted on an end surface of the housing and an engaging click for engaging the engaging aperture of the connector housing is formed on the rear holder.

4 Claims, 4 Drawing Sheets

ULTRA MULTIPLE CONNECTOR

BACKGROUND OF THE INVENTION

1. Field of the Invention

The present invention relates to ultra multiple connector and, more particularly, relates to an ultra multiple connector to be used in connecting, for example, of a wire harness, in which a plurality of connectors are mounted on one frame and which is adapted to connect the frame to a mating connector.

2. Description of the Related Art

In recent years, number of wires to be bundled in a wire harness for use in automobile, etc., is steadily increasing due to diversification in the electrical components thereof. As a result, the number of connectors for connecting the wire harness to the various electrical components is also increasing.

If, however, the number of connectors is extremely increased, much time and labor are required for the connection between the connectors and the wire harness and a large exclusive space therefor is necessary. For this reason, an ultra multiple connector having a very large number of terminal accommodating chambers within a connector has recently been proposed.

The proposed ultra multiple connector generally comprises a plurality of separate housings and a frame into which these housings are loaded. Each housing is formed as a tube opened at the both ends thereof, and a plurality of terminal accommodating chambers are formed within the housing. A terminal metal member to which a respective terminal of the wire harness is connected is loaded into each terminal accommodating chamber. A lid-like rear holder for preventing coming out of the terminal metal loaded into the terminal accommodating chamber of the housing is mounted on an end surface on the wire harness connecting side of the housing, and an outwardly projecting engaging member is integrally formed on an end edge portion of the rear holder.

Further, a bolt holder having a fixing bolt mounted thereon is formed at the inner side center portion of the frame, and hollows opened both upwardly and downwardly for the loading of the housings are formed on the portions of the frame on the both sides of the bolt holder. On the upper end edge of the hollow, an engaging member for engaging the engaging member of the rear holder mounted on the housing is formed in a manner projecting inwardly.

Here, the housing is loaded into the hollow portion of the frame such that the housing is inserted into the frame and this housing is moved laterally to position the engaging member of the rear holder into the engaging member of the frame. In this state, the housing is slightly movable in the lateral direction with respect to the frame.

In the above conventional ultra multiple connector, the frame is engaged with the mating connector on which terminal metal members are mounted in the state where the housing is loaded into the hollow portion of the frame and the engaging member of the rear holder is caused to engage the engaging member of the frame. By screwing the fixing bolt into a nut provided on the mating connector, the terminal metal member at the interior of the housing and the terminal metal member of the mating connector are connected to each other. Thereby, an ultra multiple connector having a large number of terminals may be readily connected. In this case, since the housing is adapted to be somewhat movable within the frame, the housing may be properly engaged with the mating connector even when a small error occurs in the dimensions thereof.

In such conventional ultra multiple connector, however, since the engaging member of the rear holder is engaged with the engaging member of the frame at the inside thereof to prevent the coming out of a housing from the frame, etc., the housing inside the frame is completely concealed. As a result, there is a disadvantage that, in the case where loading of the housing into the frame is incomplete or in the case where mounting of the rear holder onto the housing is incomplete, it is difficult to check such loaded state of the housing. A falling off of the housing from the frame or a coming out of the terminal metal member which has been loaded into the housing may occur when loading of the housing into the frame is incomplete or when mounting of the rear holder onto the housing is incomplete. This results in the cause of a defect in the electrical connection.

Further, the housing is loaded into the frame so that it is concealed. Therefore, if an error occurs in the terminal metal member loaded into the housing, the maintenance thereof is possible only after firstly removing the housing from the frame and then removing the rear holder from the housing. This greatly reduces the operability thereof.

The present invention has been made in view of the above.

SUMMARY OF THE INVENTION

It is an object of the present invention to provide an ultra multiple connector having a plurality of connectors mounted on a frame and adapted to connect the frame to a mating connector, wherein the ultra multiple connector is capable of securely effecting the loading of connector housing into the frame.

It is another object of the present invention to provide an ultra multiple connector capable of securing the mounting of a rear holder onto the connector housing.

It is a further object of the present invention to provide an ultra multiple connector capable of allowing an easy maintenance of terminal metal members loaded into the connector housing so as to greatly improve the operability thereof.

To achieve the above objects, there is provided an ultra multiple connector, including a frame having a plurality of hollows opened upwardly and downwardly and at least one connector housing mounted at the interior of said each hollow, said frame connected to a mating connector; the hollow of the frame having a depth shorter than a length of the connector housing, so that a portion of said connector housing in its mounted state forming an exposing portion exposed from the hollow; an engaging aperture formed on a side surface of the exposed portion of the connector housing; a rear holder removably mounted on an end surface of the connector housing for holding a terminal metal member in the housing at a predetermined position within the housing; and an engaging click formed on said rear holder for engaging the engaging aperture of the connector housing.

According to the above construction, since the depth of the hollow of the frame is short to such an extent that a portion of the housing is exposed, the mounted state of a housing may be readily checked by detecting visually or by means of a detection device the amount by which the housing is caused to project from an end surface of the frame. It is easy to find a case where the housing is caused project in excess of a normal value, i.e., when it is not securely mounted. Further, since the housing is caused to project from the frame when mounting of the housing is not complete, mounting of the housing by means of a push-in operation thereof may be readily performed.

Further, the portion of the housing for mounting the rear holder projects from the frame also when the rear holder is not completely mounted with respect to the housing. Therefore, by similarly detecting it visually or by means of a detection unit, the mounted state of the rear holder may be readily checked. In addition, since the engaging aperture of the housing is exposed from the frame, it is easy to check the engaged state between the engaging aperture and the engaging click of the rear holder.

Furthermore, if the housing is constructed as capable of removing the terminal metal from the fitting opening side of the housing, the fact that the engaging aperture of the housing is exposed allows maintenance of the terminal metal to be performed with the housing being mounted on the frame, by disengaging the engaging click for engaging the engaging aperture to remove the rear holder.

Other objects and advantages of the present invention will be apparent from the following description of an embodiment thereof with reference to the accompanying drawing.

DESCRIPTION OF THE PREFERRED EMBODIMENT

Figure 1:
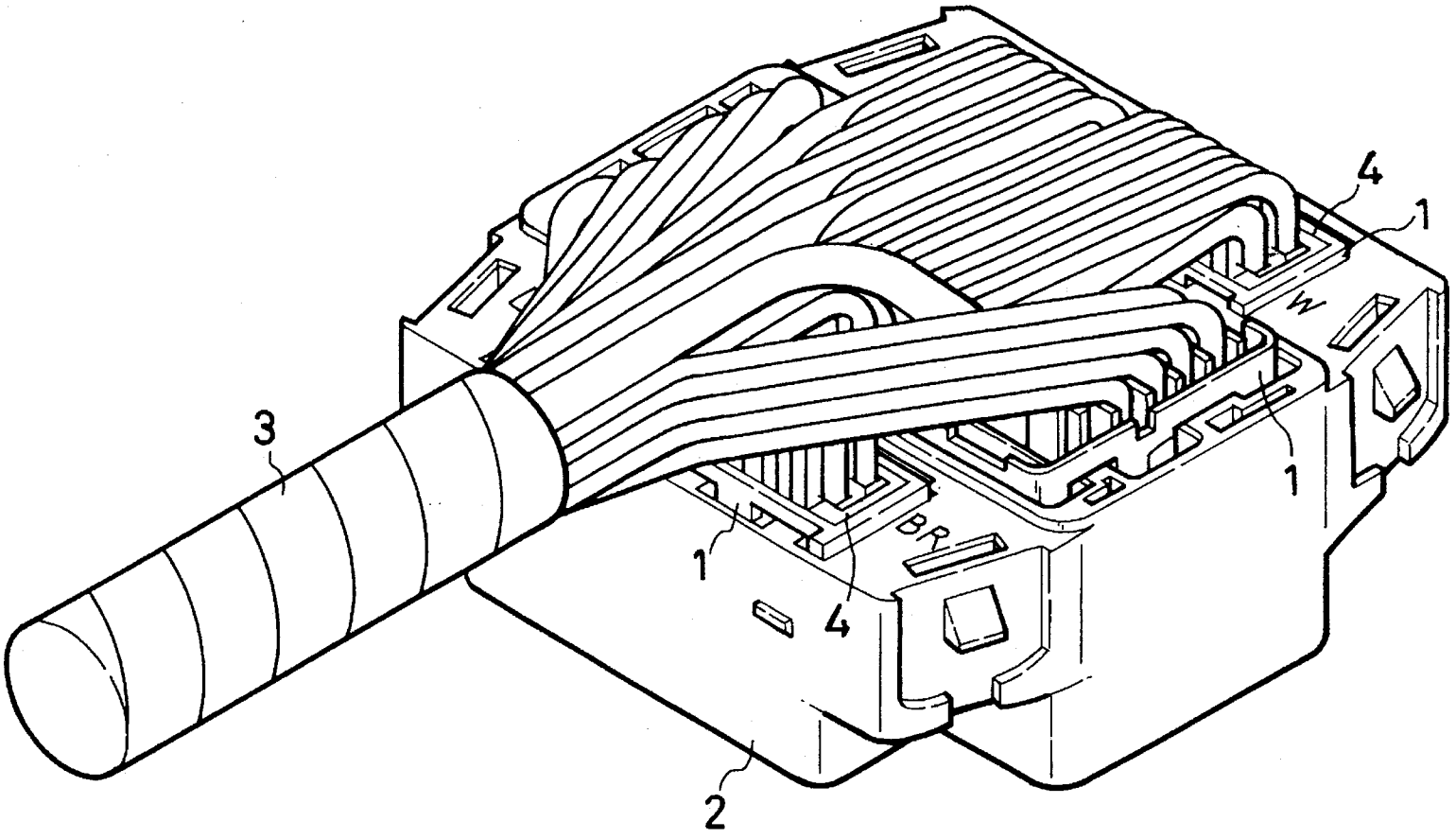
FIG. 1 is a perspective view showing an ultra multiple connector according to the present invention.
Figure 2:
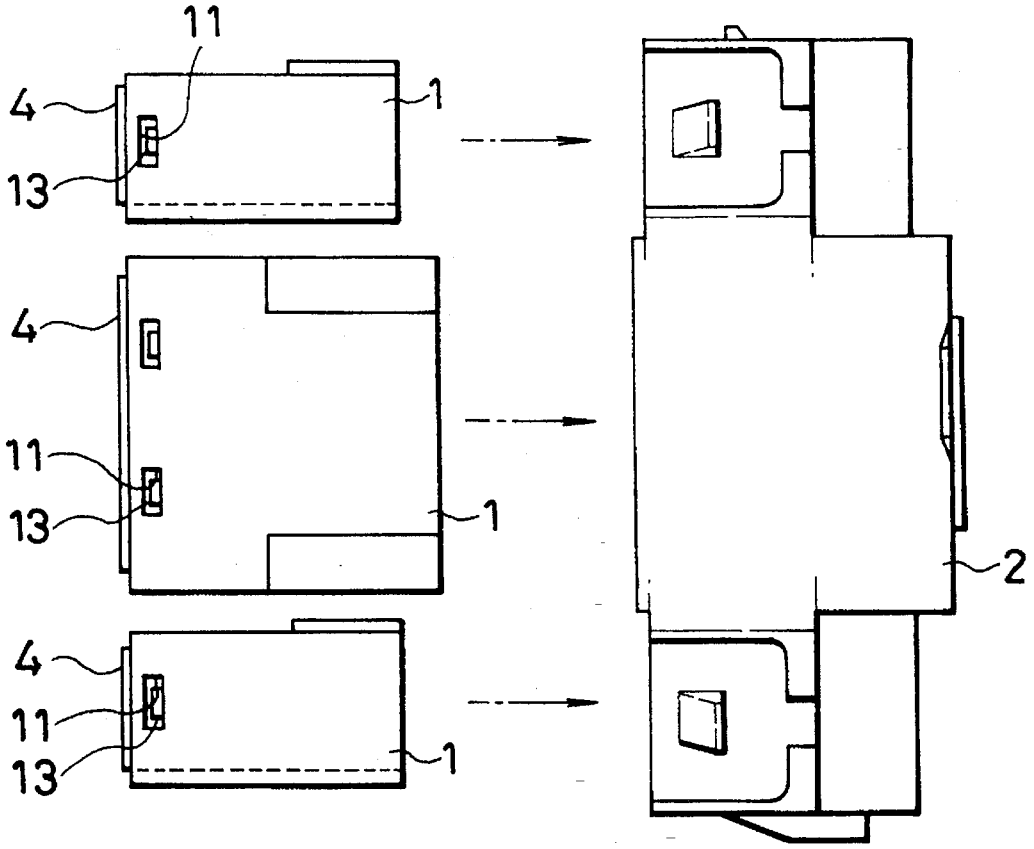
FIG. 2 is a front view showing the frame of FIG. 1 without housing being mounted thereon.
Figure 3:
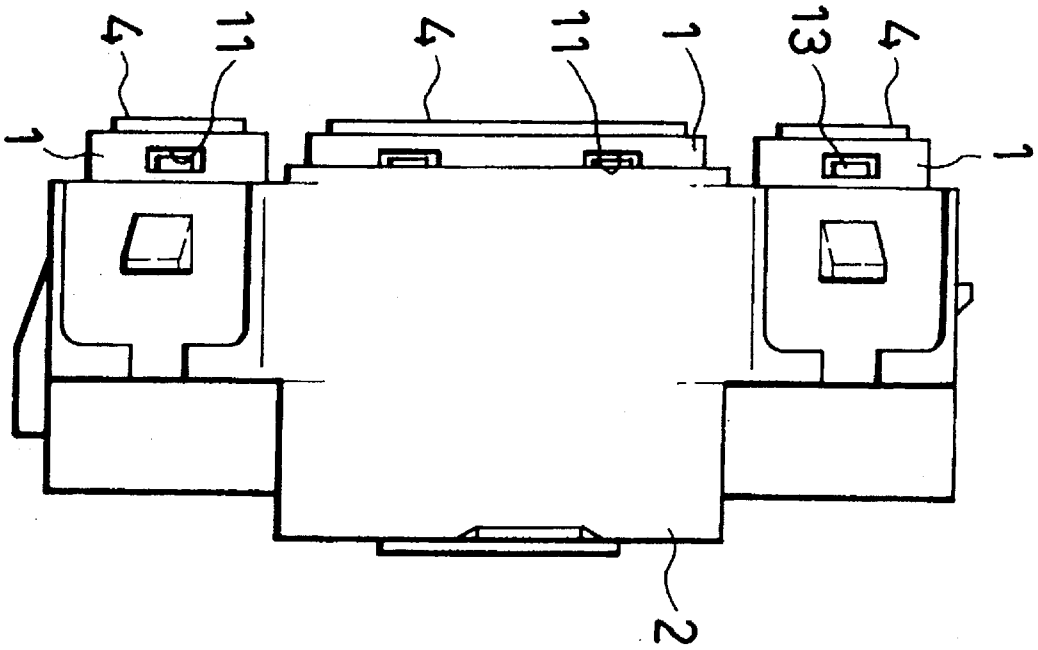
FIG. 3 is a front view showing the frame with housing mounted thereon.
Figure 4:
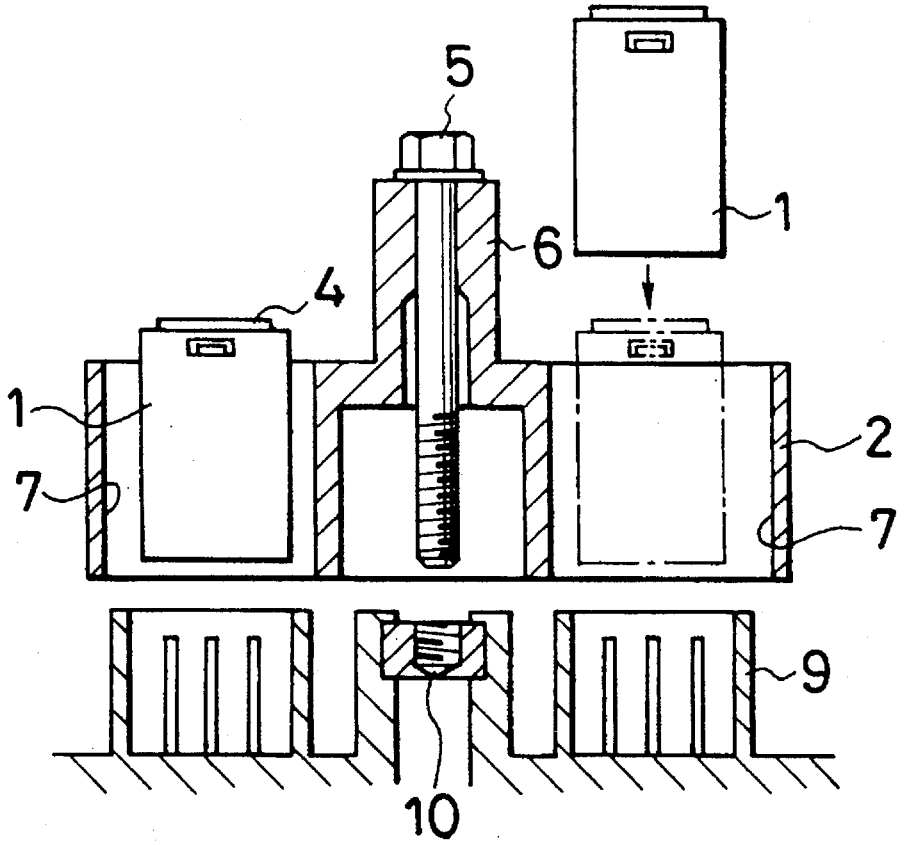
FIG. 4 is a longitudinal sectional view of an ultra multiple connector of the present invention including a mating connector, wherein, for ease of illustration, the frame and the housing are shown in their simplified form.

An ultra multiple connector according to the present invention includes a frame 2 into which a plurality of connector housings 1 are loaded and which is to be connected to a predetermined mating connector 9. Formed at the inner center portion of the frame 2 is a bolt holder 6 having a bolt 5 formed thereon for fixing to the mating connector. A plurality of hollows 7 opened upwardly and downwardly are formed around the bolt holder. The housings 1 are to be loaded into the respective hollows. The depth of the hollow portion is shorter than the length of the connector housing such that the upper portion of the connector housing in its mounted state is partially exposed from the hollow portion.

A plurality of terminal accommodating chambers (not shown) are formed at the interior of the housing 1 and are adapted to be loaded with respective terminal metal members (not shown). Connected respectively to the terminal metal members are the terminals of a wire harness 3. An engaging aperture 11 is formed on an upper side surface of the housing 1 at a position exposed from the frame 2.

Mounted removably on an end portion of the wire harness connecting side of the housing 1 is a rear holder 4 for preventing coming out of the terminal metal member loaded into the housing 1, which is formed in the shape of a frame along the end edges of the housing 1 and which has a side surface reaching at least the portion where the engaging aperture 11 is located. An engaging click 13 for engaging the engaging aperture 11 is formed at a position on the rear holder corresponding to the engaging aperture 11. Here, by mounting the rear holder 4 onto the housing 1, the terminal metal member in the housing 1 is held at a predetermined position within the housing 1.

Operation of the present embodiment will now be described.

First, predetermined terminal metal members are loaded into the terminal accommodation chambers of the housing 1 and the wire harness 3 is connected to these terminal metal members. The rear holder 4 is mounted onto an end of the housing 1 by engaging the engaging click 13 thereof with the engaging aperture 11 of the housing.

The above housing 1 is then fitted into the hollow 7 of the frame 2 to lead the housing 1 into the frame 2. The frame 2 is connected to the predetermined mating connector 9 by screwing the bolt 5 into a nut 10 provided thereon, and the terminal metal members mounted on the mating connector and the terminal metal members of the housing 1 are electrically connected to each other.

In this case, according to the present embodiment, the depth of the hollow portion 7 of the frame 2 is short to such an extent that a portion of the housing 1 is exposed. In mounting operation of the housing 1 into the frame 2, therefore, the mounted state of the housing 1 may be readily checked by detecting visually or by means of a detecting device the amount by which the housing is caused to project from the end surface of the frame 2. It is easy to find a case of the housing 1 projecting in excess of a normal value where it is not securely mounted. Further, since the housing 1 is caused to project from the frame 2 when mounting of the housing 1 is not complete, it is easy to perform mounting of the housing 1 by a push-in operation.

Further, the portion of the housing 1 for mounting the rear holder 4 projects from the frame 2 also when the rear holder 4 is not completely mounted with respect to the housing 1. Therefore, by similarly detecting it visually or by means of a detection unit, the mounted state of the rear holder 4 may be readily checked. In addition, since the engaging aperture 11 of the housing 1 is exposed from the frame 2, it is easy to check the state of engagement between the engaging aperture 11 and the engaging click 13 of the rear holder 4.

Furthermore, if the housing 1 is constructed as capable of removing the terminal metal member from the fitting opening side of the housing 1, the fact that the engaging aperture 11 of the housing 1 is exposed allows maintenance of the terminal metal member to be performed with the housing 1 being mounted on the frame 2, by disengaging the engaging click 13 for engaging the engaging aperture 11 to remove the rear holder 4 from the housing 1.

Accordingly, in the present embodiment, the depth of the hollow portion in the frame 2 is short to such an extent that the housing 1 is caused to project from the end surface of the frame 2. In addition, the engaging aperture 11 to be engaged with the engaging click 13 of the rear holder 4 is formed on the projected portion of the housing 1. It is therefore easy to check the mounted state of the housing 1 into the frame 2 based on the amount by which the housing 1 is caused to project from the end surface of the frame 2. Further, the mounted state of the rear holder 4 onto the housing 1 may be readily checked by checking the state of engagement between the engaging aperture 11 of the housing 1 and the engaging click 13 of the rear holder 4. As a result, it is possible to securely present occurrence of a defect in mounting of the housing 1 with respect to the frame 2 and a defect in mounting of the rear holder 4 with respect to the housing 1. A falling off of the housing 1 from the frame 2, a coming out of the terminal metal member loaded into the housing 1, etc., may be prevented to effect a secure electrical connection thereof.

Furthermore, maintenance of the terminal metal member may be performed while the housing 1 is mounted on the frame 2 by removing only the rear holder 4 after disengaging the engaging click 13 which engages with the engaging aperture 11 of the housing 1. Thus, the operability thereof may be greatly improved.

We claim:

1. An ultra multiple connector comprising:

a frame to be connected to a mating connector and having a plurality of hollows opened upwardly and downwardly;

at least one connector housing disposed in said each hollow, a rear holder removably mounted on and end surface of said connector housing;

said hollow of said frame having a depth shorter than a length of said connector housing, so that a portion of said connector housing in its mounted state forming an exposing portion exposed from the hollow, wherein an amount of projection by which said connector housing in its mounted state is caused to expose from an end surface of said frame is detected to check the state of mounting of said connector housing with respect to said frame.

2. An ultra multiple connector according to claim 1, further comprising:

an engaging aperture formed on a side surface of the exposed said connector housing; and an engaging click formed on said rear holder for engaging the engaging aperture of said connector housing.

3. An ultra multiple connector comprising:

a frame to be connected to a mating connector and having a plurality of hollows opened upwardly and downwardly;

at least one connector housing disposed in said each hollow and having a large number of terminal metal members contained therein and connected to a wire harness;

said hollow of said frame having a depth shorter than a length of said connector housing, so that a portion of said connector housing in its mounted state forming an exposing portion exposed from the hollow; said ultra multiple connector further comprising:

an engaging aperture formed on a side surface of the exposed portion of said connector housing;

a rear holder removably mounted on an end surface of said connector housing for holding the terminal metal members in said housing at a predetermined position within the housing; and an engaging click formed on said rear holder for engaging the engaging aperture of said connector housing.

4. An ultra multiple connector according to claim 3, wherein said connector housing is constructed such that removing of the terminal metal member is performed through a fitting opening for the housing.

* * * * *